United States Patent [19]

Olenfalk et al.

[11] Patent Number: 4,671,087

[45] Date of Patent: Jun. 9, 1987

[54] DOOR LOCK INCLUDING ELECTRICALLY ACTUABLE COUPLING ARRANGEMENT

[75] Inventors: Bengt Olenfalk, Järfälla; Göran Witt, Stockholm; Anders Sarberg, Danderyd, all of Sweden

[73] Assignee: WSO CPU-System AB, Stockholm, Sweden

[21] Appl. No.: 758,974

[22] Filed: Jul. 25, 1985

[30] Foreign Application Priority Data

Aug. 1, 1984 [SE] Sweden ..... 8403947

[51] Int. Cl.[4] ..... E05B 47/06

[52] U.S. Cl. ..... 70/283; 70/218; 70/472; 292/336.3; 292/336.5; 292/DIG. 27; 292/DIG. 52

[58] Field of Search ..... 70/275, 277, 279–282, 70/283, 379 R, 379 A, 380, 218, 472, 224, DIG. 67, 467, 471, 149, 150, 153; 292/144, 201, 336.3, 336.5, DIG. 27, 358, DIG. 24, DIG. 26, DIG. 52

[56] References Cited

U.S. PATENT DOCUMENTS

| | | | |
|---|---|---|---|
| 504,462 | 9/1893 | Tinkham . | |
| 540,025 | 5/1895 | Palmer | 70/276 |
| 657,853 | 9/1900 | Carleton . | |
| 942,605 | 12/1909 | Walter | 292/DIG. 27 X |
| 947,706 | 1/1910 | Van Tekelenburg | 292/DIG. 27 X |
| 1,888,383 | 11/1932 | Holton | 292/DIG. 27 X |
| 1,994,104 | 3/1935 | Kebort | 292/DIG. 27 X |
| 3,655,240 | 4/1972 | Du Rocher et al. | 292/201 X |
| 3,748,878 | 7/1973 | Balzano et al. . | |
| 4,073,527 | 2/1978 | Schlage | 292/DIG. 27 X |
| 4,108,482 | 8/1978 | Dietrich et al. | 292/DIG. 27 X |
| 4,177,657 | 12/1979 | Aydin . | |
| 4,411,144 | 10/1983 | Aydin . | |
| 4,429,556 | 2/1984 | Kambic . | |

FOREIGN PATENT DOCUMENTS

| | | | |
|---|---|---|---|
| 961789 | 4/1957 | Fed. Rep. of Germany | 70/283 |
| 428226 | 6/1983 | Sweden . | |
| 578670 | 4/1976 | Switzerland . | |
| 495432 | 3/1976 | U.S.S.R. | 292/DIG. 27 |
| 852166 | 3/1979 | U.S.S.R. . | |

*Primary Examiner*—Robert L. Wolfe
*Assistant Examiner*—Lloyd A. Gall
*Attorney, Agent, or Firm*—Browdy and Neimark

[57] ABSTRACT

A lock intended, for example, for a door and comprising a lock bolt and a knob, handle or corresponding device (4) and an electrically actuable coupling arrangement (7, 8, 9) arranged through the agency of an electric signal to connect the knob to the lock bolt, so that the lock bolt can be moved to a lock-release position by rotating the knob, but which in an electrically non-activated position is disengaged so as to prevent the lock bolt from being manipulated by rotation of the knob.

5 Claims, 3 Drawing Figures

2
1a
3

II
III
1c
9
1b
7
8
4
5
19
19a
6
20
18
17
16
22
21
II
III
1

DOOR LOCK INCLUDING ELECTRICALLY ACTUABLE COUPLING ARRANGEMENT

BACKGROUND OF THE INVENTION

The present invention relates to a conventional lock mechanism, for example a door lock, of the kind which incorporates a knob or corresponding device and at least one lock bolt which can be retracted to an unlocking position, by rotating the knob or like device, but with which the locking and unlocking functions of the actual lock mechanism can be activated electrically.

The need of such electrically activated locks has become progressively more apparent in recent times, as a result of the increasing use of electrical lock systems of the kind which are manipulated not with a key, but with a magnetic card provided with coded information or a button array through which a given code number can be inserted, therewith to produce an electric lock-release signal for activation of the lock.

It should be possible to mount such a lock possessing electrically actuable locking and unlocking functions in a conventional manner in a door or the like, and to include a substantially conventional lock case containing the lock bolt, and a conventional knob or corresponding device. In many applications, the lock should be so designed as to enable it to be released from its locking mode from one side of the lock, i.e. from one side of the door, without requiring an electric signal to be produced, i.e. solely by turning the knob or like device. It should also be difficult, of course, to force the lock, and the lock should be constructed so that there is little risk of the lock being damaged if an attempt is made to force the lock from the outside.

The characterizing features of the lock according to the invention are set forth in the accompanying claims.

BRIEF DESCRIPTION OF THE DRAWINGS

The invention will now be described in more detail with reference to an exemplary embodiment thereof illustrated in the accompanying drawings, in which.

DETAILED DESCRIPTION OF THE INVENTION

Figure 1:
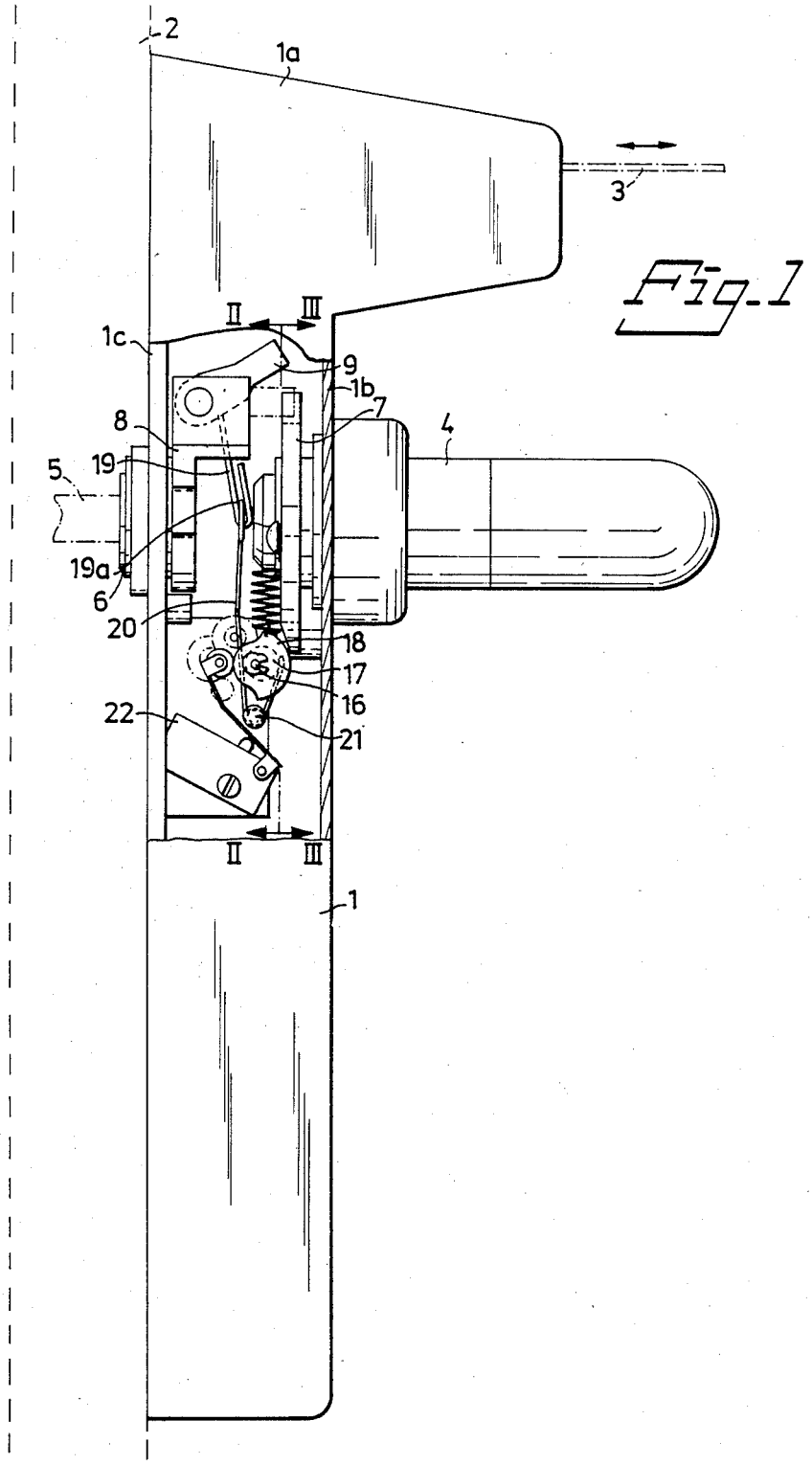
FIG. 1 is a side view, partly in section, illustrating that part of the lock relevant to the present invention.

The drawings illustrate part of a lock according to the invention which is intended to be fitted to the outside of a door for example, in which there is mounted a conventional lock case incorporating at least one lock bolt. The illustrated lock part relevant to the concept of the invention comprises a housing 1 which is intended to be mounted on the outside of the door 2, shown only schematically in the drawings, centrally of the lock case (not shown in detail) fitted in the door and incorporating at least one lock bolt for locking said door. In the illustrated embodiment, the upper part 1*a* of the housing 1 is adapted to enable it to receive a magnetic card 3, and incorporates the requisite electrical components and circuits for reading information registered on the card and for generating an electric lock-release signal upon receiving a magnetic card 3 intended therefor. The arrangement for generating this electrical lock-release signal may have any suitable form, and may comprise the arrangement described and illustrated in European patent application No. 84850102-9, for example. Other arrangements may be used for this purpose, however, for example a button array or the like with which a lock-release code number can be inserted, to give rise to the aforesaid lock-release signal.

Rotatably mounted in the forward wall 1*b* of the housing 1 is a knob 4 or like device. A shaft 5 associated with the lock case (not shown in detail) is rotatably journalled in the rear wall 1*c* of the housing 1 facing the door 2, such that the axis of rotation of the shaft is coaxial with the axis of rotation of the knob 4. The shaft 5 associated with the lock case is arranged to retract the lock bolt to its door-release position upon rotation of the shaft 5 in a conventional manner. A sleeve 6 is suitably journalled for rotation in the wall 1*c* and extended through the rear wall 1*c* of the housing, this sleeve being provided with, for example, a square hole into which the shaft 5 associated with the lock case projects, said shaft being similarly of square cross-section.

Arranged between the knob 4 and the sleeve 6 is an electrically actuable coupling arrangement which normally takes a disengaged mode, such that no connection exists between the knob 4 and the sleeve 6, therewith rendering it impossible to retract the lock bolt with the aid of the knob 4, but which can be actuated by means of an electric lock-release signal in a manner to connect the knob 4 with the sleeve 6, therewith enabling the sleeve 6, and also the shaft 5, to be rotated by means of the knob 4, to release the lock.

Figure 2:
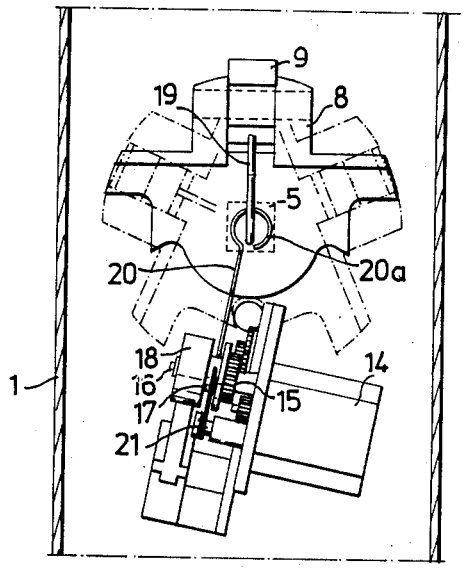
FIG. 2 is a partial sectional view taken on the line II—II in FIG. 1.
Figure 3:
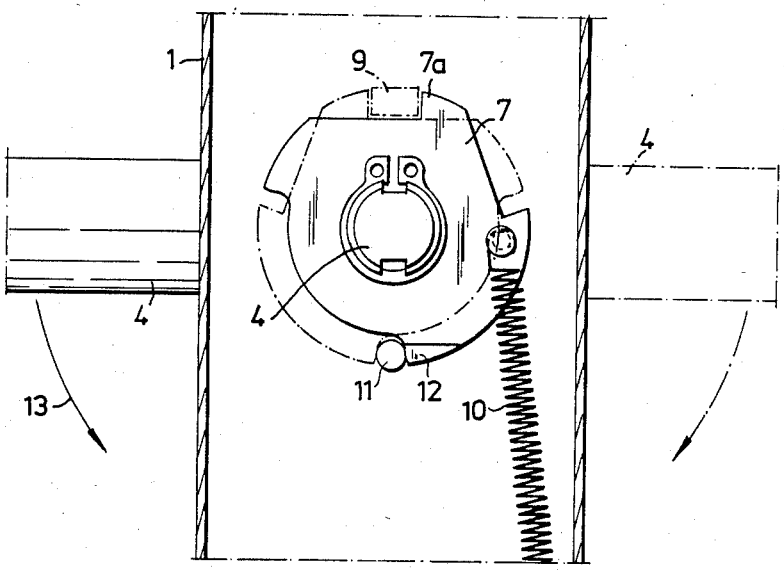
FIG. 3 is a partial sectional view taken on the line III—III in FIG. 1.

In the illustrated embodiment of the invention, the electrically actuable coupling arrangement includes a first coupling element in the form of a plate 7 which is nonrotatably mounted on the inner end of the knob 4 and which is provided around its periphery with at least one tooth or shoulder 7*a*, and a second coupling element in the form of a bracket or holder 8 which is arranged on the inner end of the sleeve 6 and in which a hook 9 is pivotably mounted. The plate 7 is biased by a spring 10, which normally holds the plate 7 and therewith the knob 4 in the position shown in full lines in FIG. 3. Rotation of the plate 7 and the knob 4 in a clockwise direction, as seen in FIG. 3, is limited by a stationary abutment peg 11, against which an abutment surface 12 on the plate 7 engages. The pivotable hook 9 on the bracket 8 is spring-biased in a counter clockwise direction, as illustrated in FIG. 1, and is normally held in the outwardly swung position illustrated in full lines in FIGS. 1 and 2. In this outwardly swung position, the hook 9 lies outside the path moved by the tooth or shoulder 7*a* on the plate 7 when the knob 4 is pressed down or turned, and hence the rotational movement of the knob 4 cannot be transmitted to the sleeve 6 and therewith the shaft 5 of the lock case. Consequently, it is impossible in this position to release the lock by turning or depressing the knob 4. Neither will force exerted on the knob 4 in an attempt to force the lock be transmitted to the lock mechanism, and is thus unable to damage the same. If, on the other hand, the pivoted hook 9 is swung to the inwardly swung position illustrated in chain lines in FIGS. 1 and 3, the hook will lie in the movement path of the tooth or shoulder 7*a* on the plate 7, and when the knob 4 is rotated or depressed in the direction shown by arrow 13 in FIG. 3, the hook 9, and therewith the bracket 8, the sleeve 6 and the shaft 5 of the lock case, will be entrained by the rotary movement of the knob 4, in a manner to retract the lock bolt to its lock-release position, enabling the door to be opened.

This inward swinging of the hook 9 so as to enable the lock to be released by means of the knob 4 in the aforedescribed manner is effected through the agency of an electric lock-release signal. In the illustrated embodiment of the invention this electric lock-release signal starts an electric motor 14 which drives, over gear drive 15, a shaft 16 on which an eccentric 17 and a cam plate 18 are mounted. The cam plate 18 acts upon a microswitch 22 in a manner such that when the motor 14 is started from the position illustrated in FIG. 1, through the agency of an electric lock-release signal, the shaft 16 together with the eccentric 17 and the cam plate 18 are rotated through one half revolution, whereupon the rotary movement is stopped by action of the microswitch 22. Subsequent to a given, pre-determined time delay, which may be determined by means of electrical circuits in the electrical assembly mounted in the part 1*a* of the housing 1, the motor 14 is re-started and rotates the shaft 16, the eccentric 17 and the cam plate 18 through a further half revolution, to the position illustrated in full lines in FIG. 1, in which position the motor is again stopped by action of the microswitch 22.

The pivotable hook 9 is connected to the eccentric 17 on the shaft 16 by means of a link mechanism incorporating two link arms 19 and 20. The one link arm 19, which in the illustrated embodiment has the form of a relatively rigid metal wire, is rigidly attached at one end to the hook 9 eccentrically in relation to the pivot axis of the hook. The other link arm 20, which in the illustrated embodiment comprises a slightly springy metal wire, has the shape of a hairpin and is pivotally mounted on a stationary peg 21, in a manner such that the two legs of the hairpin-shaped link arm 20 lie against respective opposite sides of the eccentric 17. The pivotal connecting point between the two link arms 19 and 20 is located approximately on the common rotational axis of the knob 4 and the sleeve 6. As will best be seen from FIGS. 1 and 3, the connecting joint has the form of a circular annular eye 20*a* on the link arm 20 and an eye 19*a* on the link arm 19, the eye 19*a* being freely movable around the circular eye 20*a* on the link arm 20. The annular eye 20*a* on the link arm 20 is located substantially concentrically in relation to the common axis of rotation of the knob 4 and the sleeve 6. It will be seen that when the shaft 16 and eccentric 17 are rotated through one half revolution by the motor 14, through the agency of an electric lock-release signal in the aforedescribed manner, the hook 9 will be swung by the action of the link mechanism 19,20 from the position shown in FIG. 1 in full lines to the position shown in FIG. 1 in chain lines, in which latter position the sleeve 6, and therewith the shaft 5 of the lock case, can be rotated so as to retract the lock bolt, by depressing or rotating the knob 4. When the motor 14 rotates the shaft 16 and the eccentric 17 through a further half revolution, subsequent to a given pre-determined time delay, the link mechanism 19,20, and therewith the spring-loaded hook 9, will return to the position shown in full lines in FIG. 1, so as to disengage the sleeve 6, and therewith the lock-case shaft 5, from the knob 4. The lock bolt in the lock case is therewith returned to its outwardly projecting, door-locking position in a conventional manner, under the action of a spring means arranged in the lock case. This particular construction of the pivot between the two link arms 19, 20 permits the requisite twisting or rotational movement of the bracket 8, and therewith the hook 9 carried thereby, about the common rotational axis of the sleeve 6 and the knob 4. Because the link arm 20 co-acting with the eccentric 17 is sprung, the electric motor 14 is able to continue to rotate through one half revolution when manipulating the lock between a locking and releasing position in the aforedescribed manner, even though, for some reason or other, mechanical locking should occur between the hook 9 and the plate 7 in a manner to prevent the hook 9 from being swung in the manner intended. Due to the fact that the motor 14 will rotate in such cases through one half revolution and be automatically stopped by the microswitch 22, overloading of and damage to the motor is avoided.

When the knob or corresponding device (not shown in detail in the drawings) located on the other side of the door 2 is connected directly to the shaft 5 of the lock case, it will be seen that the door can be opened from the inside without requiring the presence of an electric lock-release signal. If, on the other hand, the door is to be opened both from the outside and from the inside of the door solely through the action of an electric lock-release signal, a coupling arrangement of the aforedescribed and illustrated kind actuable by said lock-release signal is also arranged on the inside of the door.

The lock illustrated in full lines in the drawing is constructed and mounted for a righthand door. In order to allow the lock to be used also for a lefthand hung door, the knob 4 can be mounted in the manner shown in chain lines in FIG. 3, while at the same time reversing the plate 7 and mounting it on the knob in the position shown in chain lines in FIG. 3. In conjunction herewith the spring 10 is also reversed, so that it strives to rotate the plate 7, and therewith the knob 4, in a counter clockwise direction in FIG. 3. As will be seen from FIG. 3, the plate 7 is also able to co-act with the hook 9 on the bracket 8 in this new position, in the same manner as that aforedescribed.

It will be seen that a lock according to the invention can be constructed in various ways over and above that described by way of example in the aforegoing. For example, the electrically actuable coupling arrangement between the knob or like device and the lock-case shaft determining the position of the lock bolt can have various mutually different forms. In this respect, the electrical operating means need not necessarily comprise an electric rotatable motor, but may have the form of solenoid or some other electrical operating means. A rotatable motor, however, has the advantage that it takes current only while it is rotating, and hence the total current consumption of the lock is very small.

We claim:

1. A lock comprising a lock bolt and a knob means, a first shaft connected to the knob means and arranged to rotate when turning the knob means, a second rotatable shaft whose rotational axis is coaxial in relation to the first shaft and which is arranged upon rotation to displaee the lock bolt between a lock-release and lock-engage position, and an electrically actuable coupling arrangement provided for releasably connecting said first and second shafts with one another to enable the lock bolt to be moved to a lock-release position upon rotation of the knob means, said electrically actuable coupling arrangement including a plate non-rotatably mounted on one of the aforesaid shafts and the periphery of which has provided therein at least one tooth, a bracket structure non-rotatably mounted on the other of said two shafts and carrying a catch pivotable about a pivot axis extending perpendicularly in relation to and at a distance from the common rotational axis of the said mutually coaxial first and second shafts, and an electrical operating means operatively connected with said catch for swinging the same into and out of thelpath of movement of said tooth, said electrical operating means including a rotatable electric motor stationarily mounted with its shaft extending substantially perpendicularly in relation to and located at a distance from the common rotational axis of said mutually coaxial first and second shafts, an eccentric mounted on said motor shaft, and a link mechanism arranged between the catch and said eccentric for swinging the catch about its pivot axis upon rotation of the motor.

2. A lock as claimed in claim 1, wherein said link mechanism incorporates two pivotally interconnected link arms, one of said link arms having an end connected to said catch eccentrically in relation to the pivot axis of the catch, and the other of said link arms being pivotally mounted on a stationary peg extending parallel with the shaft of the motor and abutting said eccentric, the pivot connection between the two link arms being located substantially on the common rotational axis of the said mutually coaxial first and second shafts.

3. A lock as claimed in claim 2, wherein the pivot connection between said two link arms comprises a circular annulus attached to one link arm and being substantially concentrical in relation to the common rotational axis of the said mutually coaxial first and second shafts, and an eye located on the other link arm and being freely slidable along said annulus.

4. A lock as claimed in claim 2, wherein said other link arm is resilient.

5. A lock as claimed in claim 2, wherein said other link arm has the shape of a hairpin with two legs and a portion joinging said two legs, said other link arm being pivotally mounted at said portion and said two legs abutting said eccentric at opposite sides thereof.

* * * * *